US008764614B2

(12) United States Patent
Emick

(10) Patent No.: US 8,764,614 B2
(45) Date of Patent: Jul. 1, 2014

(54) CENTER PULL CABLE HANDLE APPARATUS

(76) Inventor: Daniel W. Emick, Montoursville, PA (US)

( * ) Notice: Subject to any disclaimer, the term of this patent is extended or adjusted under 35 U.S.C. 154(b) by 427 days.

(21) Appl. No.: 13/065,829

(22) Filed: Mar. 29, 2011

(65) Prior Publication Data

US 2011/0245051 A1 Oct. 6, 2011

Related U.S. Application Data

(60) Provisional application No. 61/341,401, filed on Mar. 31, 2010.

(51) Int. Cl.
*A63B 21/00* (2006.01)

(52) U.S. Cl.
USPC ..... 482/48; 482/50; 482/81; 482/82

(58) Field of Classification Search
USPC ..... 482/49, 93, 44, 45, 46, 47, 48, 50, 81, 482/92, 694; D21/694
See application file for complete search history.

(56) References Cited

U.S. PATENT DOCUMENTS 4,423,866 A * 1/1984 Stolba ..... 482/91
4,756,527 A 7/1988 Ledbetter
4,979,731 A 12/1990 Hermelin
5,533,952 A 7/1996 Schaber
5,556,369 A 9/1996 Roberts
5,746,687 A * 5/1998 Vial et al. ..... 482/126
7,008,355 B2 3/2006 Emick
7,341,544 B2 * 3/2008 St. George et al. ..... 482/82
7,566,292 B1 7/2009 Hauser et al.
2004/0248713 A1 12/2004 Campanaro et al.
2010/0124859 A1 5/2010 Bucknell et al.

OTHER PUBLICATIONS http://www.exercise-equipment-parts.com.
http://www.newyorkbarbells.com/usa-5473.html.
http://www.sportsmith.net/ItemForm.aspx?Item=P16007.
http://www.americanfitness.net/motiontransfercableattachment.aspx.
http://www.americanfitness.net/pulluphandles.aspx.

* cited by examiner

*Primary Examiner* — Jerome W Donnelly
(74) *Attorney, Agent, or Firm* — Thomas R. Shaffer

(57) ABSTRACT

A center pull cable handle apparatus includes a length of hollow cylindrical steel tube. An outer grip layer is provided on the cylindrical tube. The grip layer and the tube each have a wall opening. A length of aircraft cable having a first cable end extends through the wall opening and is crimped in position inside the steel tube with a cable nut. A connector is provided on an opposite cable end. A length of a soft flexible tubing surrounds the cable between the grip layer and the connector. When a user grasps the handle the first cable end is located inside the grasp of the user and said cable and tubing pass between two fingers of the user.

11 Claims, 11 Drawing Sheets

PRIOR ART

CENTER PULL CABLE HANDLE APPARATUS

This application claims priority from the disclosure made in Provisional Patent Application No. 61/341,401 filed Mar. 31, 2010.

BACKGROUND OF THE INVENTION

1. Field of the Invention

The present invention relates to a center pull cable handle apparatus. More specifically it relates to a center pull cable handle which effectively and comfortably replaces and improves the griping interface between a user and various exercise devices.

2. Description of the Prior Art

A variety of handles have been proposed for use with exercise devices or as a way to connect a handle to a cable or wire rope.

Many existing cable handles are commonly referred to as stirrups because of their resemblance to the same. These handles are simply handles which attach to cable weight stack machines in order that exercisers may utilize the machine for a variety of popular exercises. Existing cable handles are typically formed of a solid round steel rod shaped into 3 or 4 sided square or triangular configurations. The top of the existing cable handles feature a fixed or swiveling hook location for snap hook attachment to exercise machines, as well as a spinning tubular handle for gripping at the bottom of the unit. The benefits of the existing stirrup type cable are that they are of indestructible simplicity in form and function. Drawbacks associated with these existing cable handles are the heavy weight of the units due to the solid steel construction and, in addition, metal on metal contact squeaks generated by the spinning handles. Additionally, control of the units is less than optimal due to the location of the cable handle attachment points some distance away from the gripping point. Lastly, due in large part to limitations of snap hook, machine cable and cable handle attachment hole inflexibility, optimal freedom of movement during exercise is not made possible. This also applies to user movement limitations as defined by implements fixed components.

Roberts, U.S. Pat. No. 5,556,369 shows in FIG. 1 a cable handle which allows the user to grip and pull in the same longitudinal direction as the cable. FIG. 2 shows one possible triangular stirrup type arrangement of the general type described above.

Schaber, U.S. Pat. No. 5,533,952 discloses a single handle which can be used to grip and pull longitudinally to the cable as shown in FIG. 4 or by wrapping the cable around the anchor point 2 on the handle grip assembly 9 to grip and pull transversely to the cable as shown in FIG. 6.

Hauser et al., U.S. Pat. No. 7,566,292, shows a stirrup type handle rotatably connected to a hook.

Ledbetter, U.S. Pat. No. 4,756,527, shows a stirrup type handle connected to a strap with a connection hook thereon.

Hermelin, U.S. Pat. No. 4,979,731, shows a well known cable handle which only allows gripping and pulling longitudinally relative to the cable.

Campanaro et al., United States Patent Application No. US 2004/0248713, published Dec. 9, 2004, shows stirrup type handles 980 which are only attached at one end of the handle and include a bracket piece which bends toward the center of the handle for attachment to a cable at a spaced location from the center of the handle.

Bucknell et al., United States Patent Application No. US 2010/0124859, published May 20, 2010, discloses a complex compound rotational grip for a paddle shaft.

A variety of commercially available products are also available and known. Thirteen examples of such products will be identified and briefly discussed and all of these products except for examples 8, 10 and 11 may be seen on the web at http://www.exercise-equipment-parts.com and clicking on "cable attachments" from the menu on the left side of the page.

Example 1 is a Cable Crossover Handle-Open Sided-Swivel Handle.

Example 2 is a Cable Handle Attachment-Rubberized Grip.

Example 3 is Cable Crossover Handle-Knurled Swivel Handle.

Example 4 is a Cable Cross Over Attachment Handle-Swivel Knurled Grip.

Example 5 is a Nylon Strap Handle-Rubber Grip.

Example 6 is a Lat Low Row Strap-Black Nylon-Rubber Grips.

Example 7 is a Dual Handle Free-Action Chain Stirrup Cable Attachment.

Example 8 is another example of a Stirrup Handles and can be seen at http://www.newyorkbarbells.com/usa-5473.html.

Example 9 is a Lat Pull Down Attachment Handle-90 Degrees-Opposing Grip. Each of these Examples 1-7 and 9 show various forms of stirrup handles used in connection with exercise or exercise devices.

Example 10 is a Seated Row Double-D Handle with Contoured, Knurled Grips and can be seen at http:/www.sportsmith.net/ItemForm.aspx?Item=P16007. The functions of this device can be performed with the embodiment of the present invention shown in FIG. 4.

Example 11 is a Motion Transfer Cable Attachment and can be seen at http:/www.americanfitness.net/motiontransfercableattachment.aspx. The functions of this device can be performed with the embodiment of the present invention shown in FIGS. 3 and 10.

Example 12 shows Stamina Rotating Pull Up Handles which can be seen at http://www.americanfitness.net/pulluphandles.aspx. This device is similar to that shown in Hauser et al., U.S. Pat. No. 7,566,292 described above. The functions of these devices can be performed with the embodiment of the present invention shown in FIG. 11 which can be utilized with a hook member of the type shown in FIG. 7 of Applicant's U.S. Pat. No. 7,008,355.

Example 13 is a Body Solid Ab Crunch Harness Cable. The embodiment of the present invention shown in FIG. 2 is designed to perform the same function as this device but in a superior manner.

SUMMARY OF THE INVENTION

The present invention provides a center pull cable handle which provides exercisers with superior grip control and optimal freedom of movement in a lightweight and durable design. In contrast to the common stirrup handle, the present invention achieves optimal grip control by centering the resistance in the palm of the hand as opposed to some distance away as it is with existing handles. Additionally metal to metal contact noises are a non-issue with the present invention because it has a non-moving parts design. The present invention preferably provides a flexible attachment cable which provides for superior freedom and movement necessary for optimal conditioning, effect and injury prevention. The center pull cable handles of the present invention's nonintimidating strong and lightweight design delivers mass utility appeal with regards to exerciser benefits. The invention also provides the shipping and manufacturing cost savings which are realized by its positive design and materials being utilized. Lastly, the present invention provides for numerous configurations which mimic other common exercise implements. The present invention thereby delivers its benefits for multiple other exercise devices.

In its simplest form, the present invention provides a center pull cable handle apparatus comprising: a) a length of hollow cylindrical steel tube having a cylindrical wall portion, a first open tube end, a second open tube end and an empty space between said first open tube end and said second open tube end, said cylindrical wall having a cable tube wall opening extending through the wall of the tube midway along the length of the tube between the first open tube end and the second open tube end; b) an outer grip layer on said cylindrical wall, said grip layer having a cable grip wall opening which is positioned adjacent to and aligned with said cable tube wall opening; c) a length of aircraft cable having a first cable end extending through said cable tube wall opening and said cable grip layer opening and positioned in said empty space and having a second cable end extending transversely outward away from said grip layer; d) a cable nut crimped onto said first cable end and positioned in said empty space, said cable nut being larger than said cable wall opening whereby securing said first cable end inside said steel tube; e) a connector attached to said second cable end; and f) a length of flexible tubing surrounding said cable, said length of tubing extending from said grip layer to said connector, whereby when a user grasps the handle the first cable end is located inside the grasp of the user and said cable and tubing pass between two fingers of the user.

Preferably, the outer grip layer further comprises a rubberized handle grip member having a grip wall tightly surrounding said cylindrical wall and having a grip end covering said first open tube end, and a handle plug having a generally cylindrical insert portion sized to enter and be frictionally held inside said second tube opening and having a plug end and flange portion covering said second tube opening.

Alternatively, in one embodiment the outer grip layer is formed of foam which surrounds said cylindrical wall.

In another embodiment, said outer grip layer is formed of textured paint.

Preferably, the length of flexible tubing is longer than a distance from said grip layer to said connector whereby said length of tubing is compressed between said grip layer and said connector causing a gapless tight fit at an interface of the latex tubing and the grip layer.

Preferably said flexible tubing is formed of latex but may be formed of vinyl or any other soft material.

Preferably, said connector further comprises a crimp style cable nut having a first nut opening and second nut opening and a cable thimble with said second cable end extending though said first nut opening, thence around said thimble and thence through said second nut opening and being crimped in place. Preferably, said second cable end extends through said second nut opening and forms the second end of a second center pull handle apparatus whereby two center pull handle devices are connected to a single connector at a juxtaposed location.

In an alternative embodiment, said connector further comprises a ball crimp member crimped onto said second cable end with said ball member extending through a slot in a yoke, said yoke pivotally mounted to a square tubular block adapted for connection to an exercise machine. It is to be understood that any known type of hook, ball, or connector can be crimped onto the second cable end so that it can be connected to some other exercise equipment.

In one embodiment, the connector further comprises a steel tube connector having an opening for said second cable end secured with a crimped cable nut, said steel tube connector having a second opening, spaced from said first opening, for a second cable end of a second center pull handle apparatus whereby two center pull handle devices are connected to a single connector at a spaced apart location, said steel tube connector having a central hook for attachment to an exercise machine.

DETAILED DESCRIPTION OF THE PREFERRED EMBODIMENTS

Figure 1:
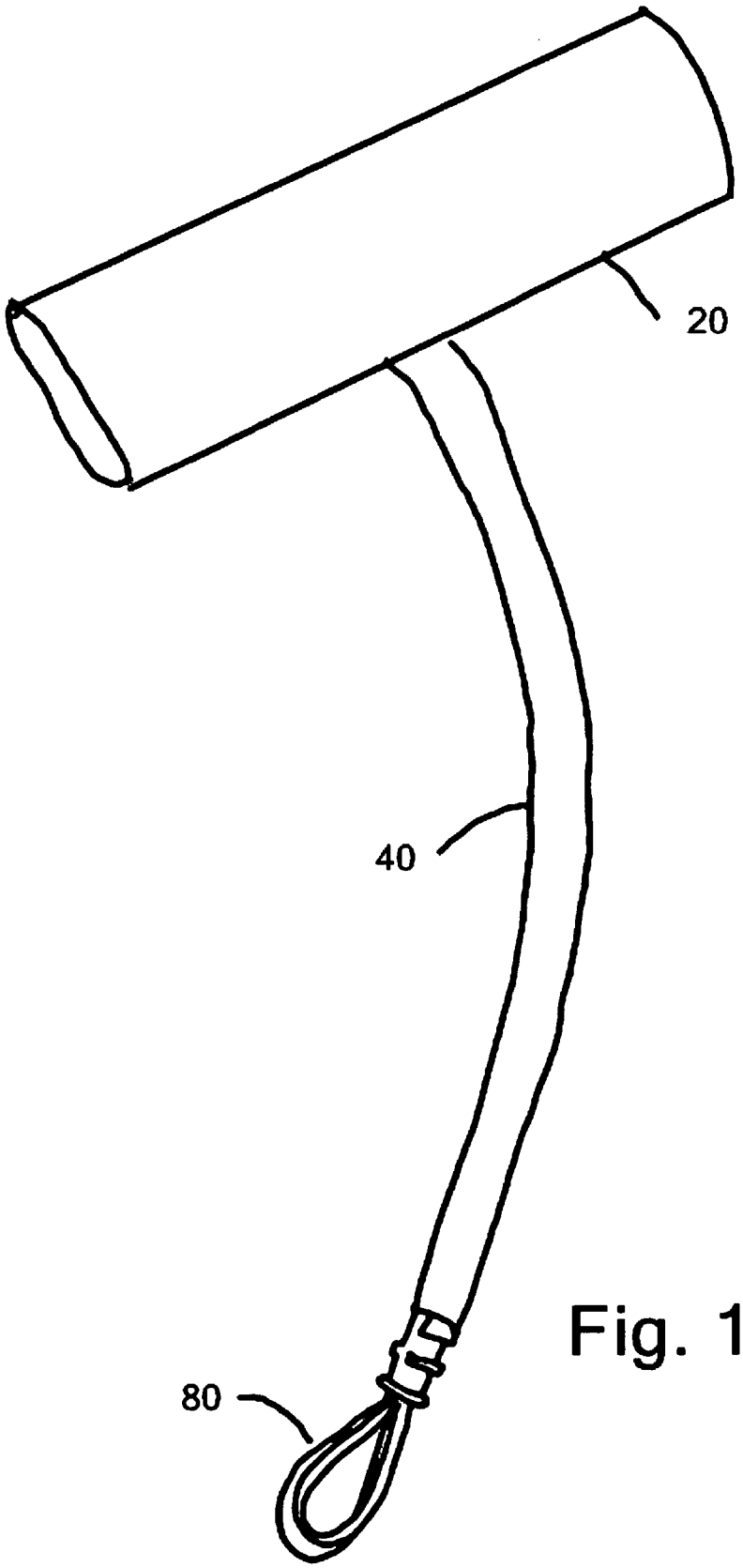
FIG. 1 is a perspective view showing the center pull cable handle apparatus of the present invention.

FIG. 1 shows the major components of the presently preferred embodiment of the present invention including a cylindrical handle 20, a soft coated cable 40 and a connector 80.

Figure 2:
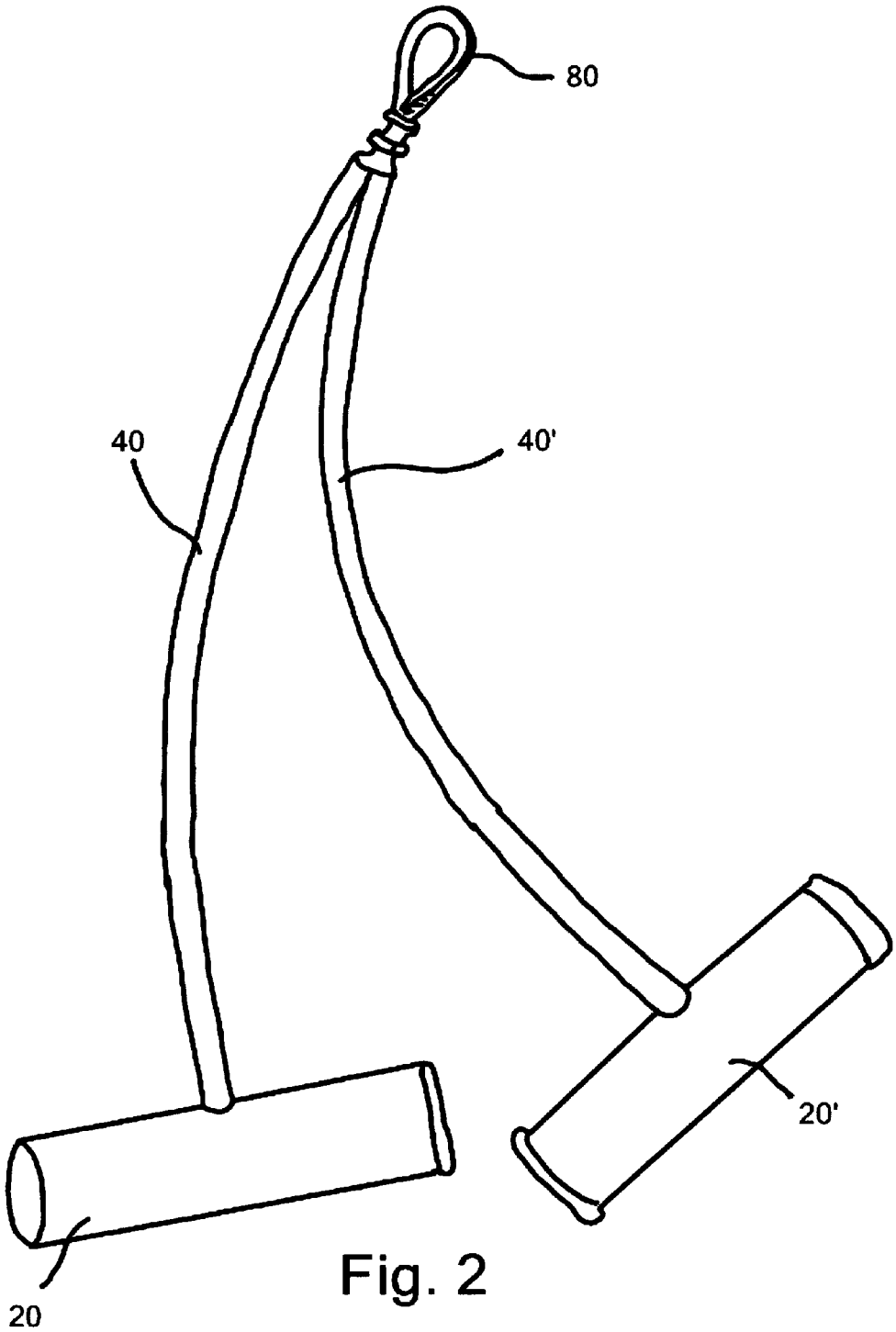
FIG. 2 is a perspective view of an apparatus according to the present invention having two center pull handles with cables connected to a single connector.

FIG. 2 shows an alternative embodiment in which a pair of handles 20 and 20' and corresponding coated cables 40 and 40' are connected to a single connector 80. This allows for the user to use both hands 20 and 20' to pull through two cables 40 and 40' connected to the same connection point 80.

Figure 3:
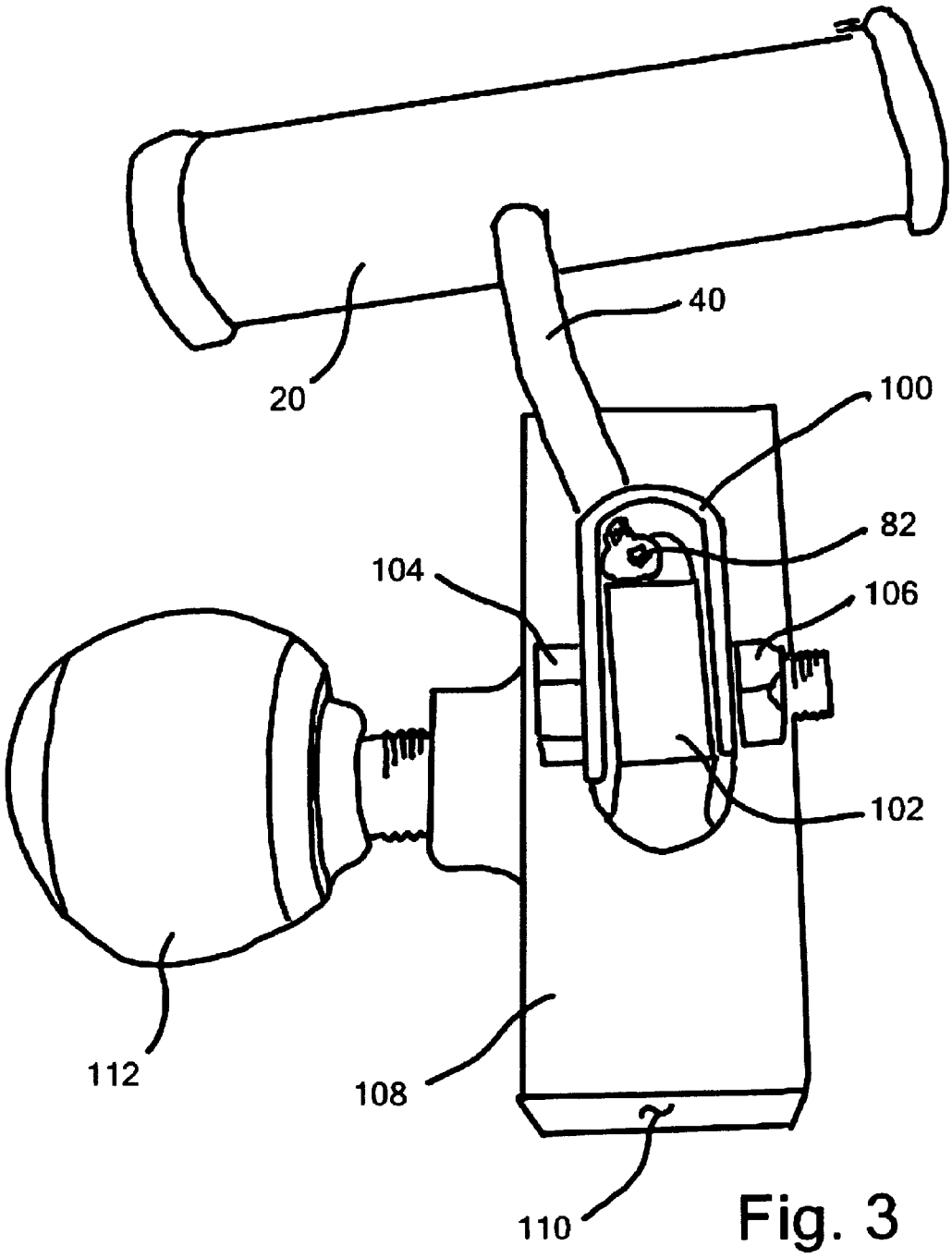
FIG. 3 is a perspective view of an embodiment of the present invention where the connector is a ball member attached in the slot of a yoke.
Figure 10:
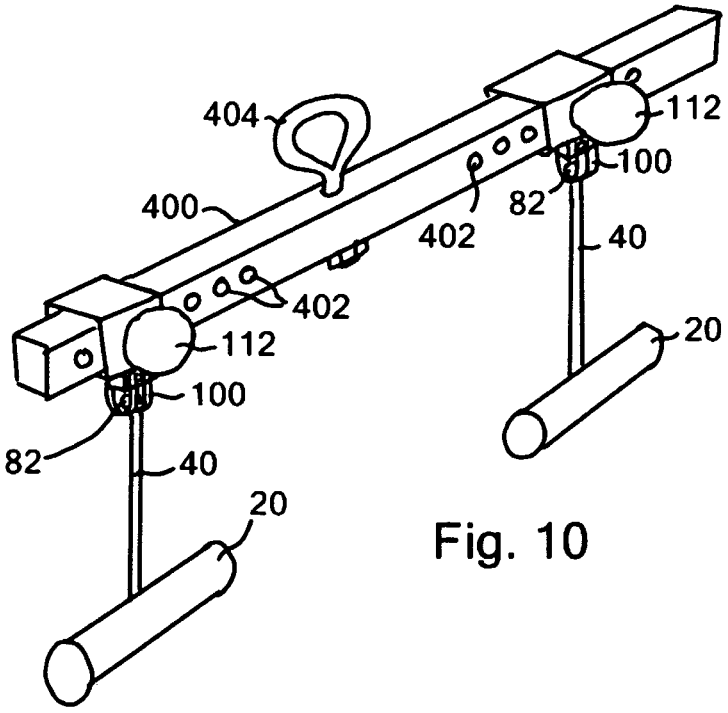
FIG. 10 is a perspective view of an embodiment of the present invention which allows for a pair of cable handles to be adjustably mounted on a single bar connector.

FIG. 3 shows an embodiment of the present invention which is adapted for use with the device shown in FIG. 10. In this case the handle 20 and soft coated cable 40 utilizes a connector in the form of a ball 82 which is crimped onto a second end of the cable. The ball 82 is captured in a slotted yoke 100. The yoke 100 is pivotally connected to a block 102 by bolt 104 and nut 106. The block 102 is preferably welded to one side of a short hollow tube 108 which has a square cross section. The tube 108 has an opening 110 which extends the length of the tube. A popper 112 which has a pin member (not shown) which can be moved outwardly by pulling on the popper hand grip 112 and which is spring loaded to return to an inward position. A pair of these devices as shown in FIG. 3 are shown as mounted in a spaced apart relationship on bar member 400 in FIG. 10. The bar member 400 also has a square cross section which slips into the openings 110 of the short tubes 108. As shown in FIG. 10 the popper 112 can be pulled out so that the entire assembly can be slid to a desired location at which time the popper 112 is released and the pin (not shown) will lock the assembly in place on the bar 400 by entering one of the plurality of hole 402 provided in the bar 400. With this arrangement, the pair of assemblies can be adjusted to be closer together or further apart on the bar 400 depending on the size of the user and the desired adjustment. A hook 404 is provided on the bar 400 to allow attachment to a desired exercise device.

Figure 4:
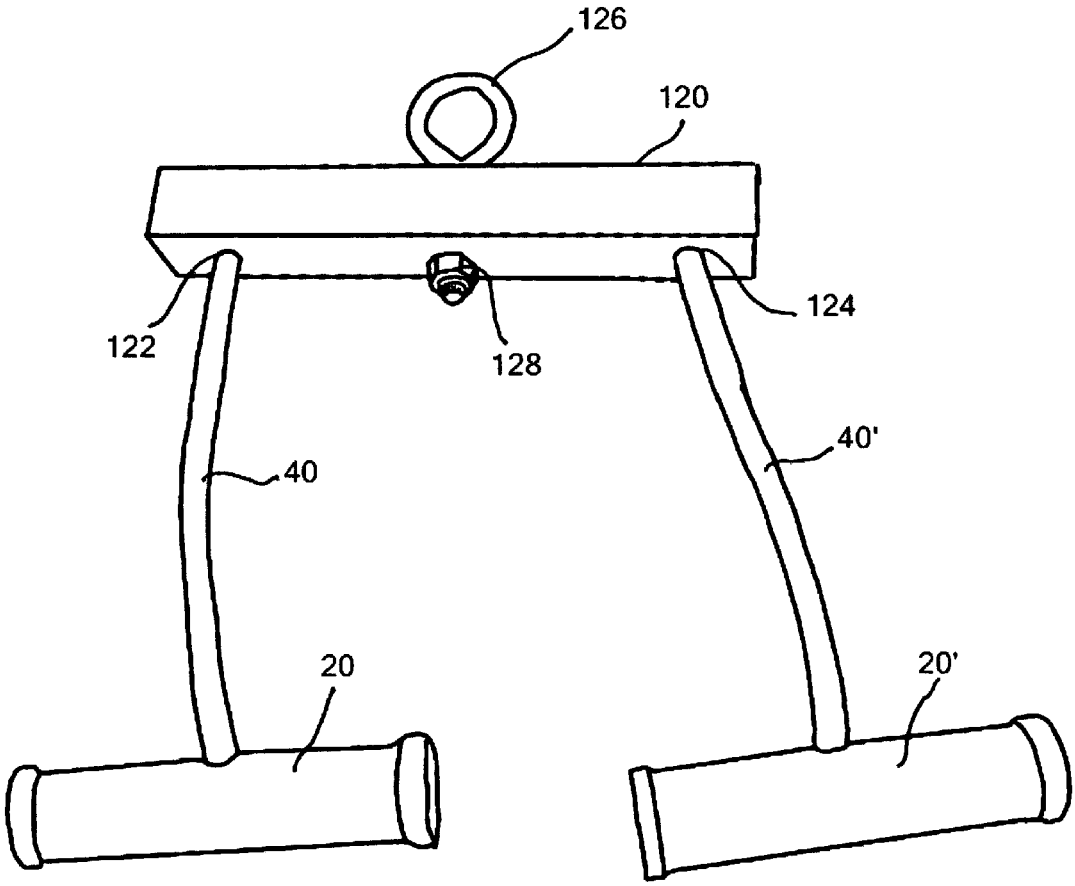
FIG. 4 is a perspective view of an embodiment of the present invention including two center pull handles with cables connected to a connector rod at spaced apart locations.

FIG. 4 shows yet another embodiment of the invention which is similar in concept to that of FIG. 10 but which is not adjustable. In this case a medium length bar 120 having a hook 126 and bolt 128 for attachment of the assembly to an exercise machine is provided. In this case handle 20 and the soft coated cable 40 are attached at its second end by a cable nut (not shown) inside the bar 120. The second end of the cable 40 enters the bar 120 through an opening 122. Similarly, handle 20' and the soft coated cable 40' is attached at its second end by a cable nut (not shown) inside the bar 120. The second end of the cable 40' enters the bar 120 through an opening 124.

Figure 5:
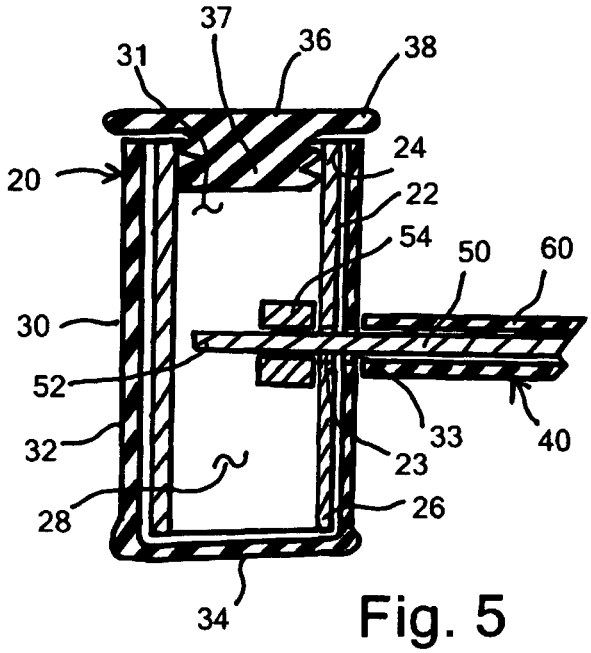
FIG. 5 is a cross sectional view of the handle and first end of the cable of the present invention.

As shown in FIG. 5, the present invention has a handle 20 which includes a length of hollow cylindrical steel tube 22 having a wall portion 22, a first open tube end 24 and a second open tube end 26 with an empty space 28 between said first tube end 24 and said second tube end 26. The cylindrical wall 22 has a cable tube wall opening 23 which extends through the wall 22 of the tube midway along the length of the tube between the first open tube end 24 and the second open tube end 26. An outer grip layer 30 is provided on or over the cylindrical wall 22. This layer may be in the form of textured paint, a layer of foam material, tape, or any other material layer which provides an increased and more comfortably grip than gripping the steel tube directly. The presently preferred embodiment is shown in FIG. 5. The rubberized grip layer 30 includes a cylindrical grip wall 32 and grip end 34. The grip wall 32 has a cable grip opening 33 which is positioned adjacent to and aligned with the cable tube wall opening 23. This portion of the grip layer in this embodiment is much like a rubberized handle bar grip used on bicycles and has an open end 31 to allow it to be placed over the steel tube 20. A cylindrical insert portion 37 is sized to enter and be frictionally held inside said the second tube opening 24 which has a plug end 36 which enters into space 31 and a flange portion 38 covering the second tube opening 24.

The cable 40 includes a length of aircraft cable or wire rope 50 which has a first cable end 52 which extends through the cable tube wall opening 23 and the cable grip layer opening 32 and into the empty space 28 where a cable nut 54 is crimped onto the first cable end 52. A second cable end 56 extends transversely outward away from the handle 20 and the grip layer 30.

A length of flexible tubing 60 surrounds the cable 50. The tubing which is preferably formed of a soft material such as latex or vinyl 60 extends from the grip layer 30 to a connector 80. The provision of a soft, flexible tubing 60 is critical to the present invention since such tubing provides a cushion and protects the hands and fingers of a user from the rough steel cable.

Figure 6A:
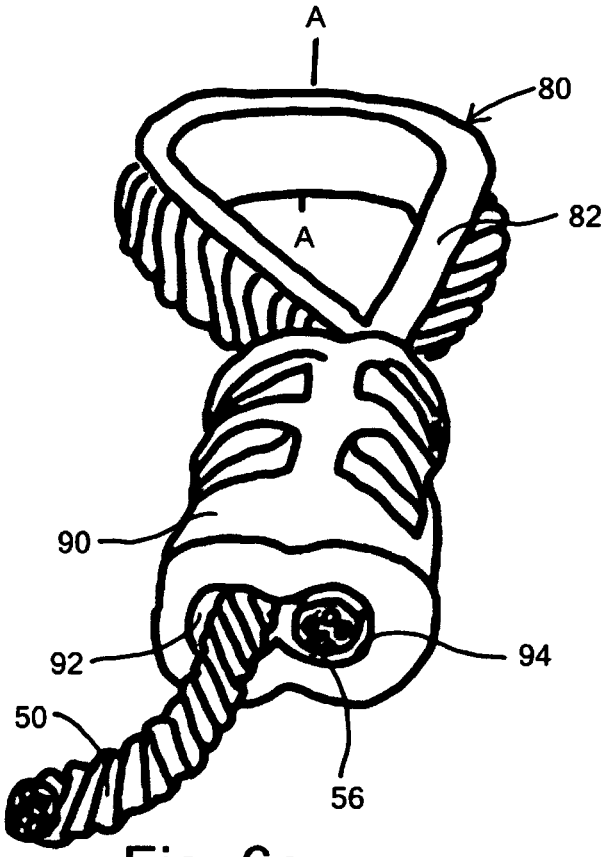
Fig. 6a PRIOR ART
FIG. 6*a* is a perspective view of a crimp style nut having a first nut opening and a second nut opening and of a thimble with a cable.
Figure 6B:
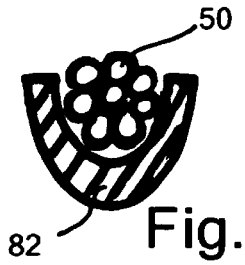
FIG. 6*b* is a cross sectional view taken on the line A-A of FIG. 6.

The present invention can be used with any kind of connector which can be a simple hook attached to the second cable end 56 or a ball and slot connector as shown in FIG. 3. The connector can also include a bar such as bar 120 in FIG. 4 or bar 400 as shown in FIG. 10. Preferably, however, the presently preferred connector is a well known prior art cable connector 80 as shown in FIGS. 6*a* and 6*b*. This connector 80 includes a crimp style cable nut 90 having a first nut opening 92 and a second nut opening 94. A tear shaped cable thimble 82 is provided with the second cable end 56 extending through the first nut opening 92 thence around the thimble 82 and thence through the second nut opening 94 with said cable nut 90 being crimped to hold the cable end 56 firmly in place. As shown in FIGS. 1 and 2, respectively, this type of connector 80 can be used to connect one or two cables 40, 40'.

Figure 7:
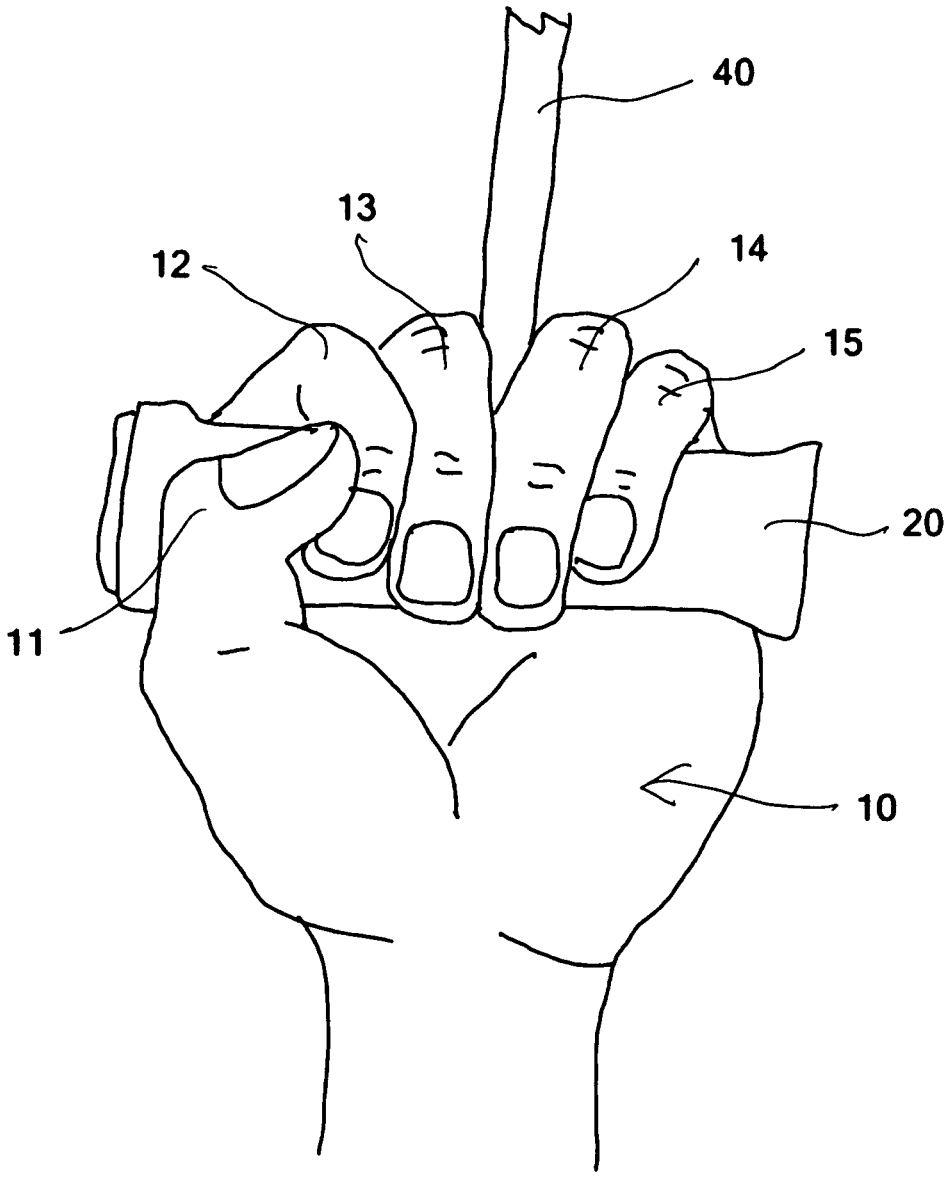
FIG. 7 is a perspective view showing the center pull handle apparatus as gripped in the hand of a user.

As shown in FIG. 7 when a user grasps the handle 20, the first cable end is located inside the users grasping hand and the tubing around the cable 40 passes between fingers 13 and 14 (although some users may prefer to grasp the handle with the cable passing between fingers 12 and 13 or possibly 14 and 15). In any of these cases, the user will be able to firmly and safely grasp the handle and have a great deal of control over the load which is lifted. Because the cable 40 is connected within the grasping hand of the user, the user's hand is required to stabilize the load by using various muscles in the hand, wrist and fingers. The hand can move at the wrist in virtually any direction and the use of the present invention not only strengthens and tones the hand, fingers and wrist but also makes the use of a variety of existing exercise machines more safe and easy to use by providing a proper handle which is not restricted to any particular path but which can be freely adjusted by the users hand muscles during any lifting activity.

As best shown in FIG. 7, because of the soft flexible tubing 60 provided over the cable or wire rope 50, the hand of a user is protected from abrasion from the cable. This allows a grip location directly over the connection point of the cable 40 to the handle 20. As best shown in FIG. 5, when the flexible tubing is properly sized (i.e. slightly longer than and compressed slightly between the handle 20 and connector 80), a tight joint is formed at the interface between the end of the flexible tubing and the outer grip layer 30 of the handle 20. This prevents any pinching of the skin at the location of such interface.

Figure 8:
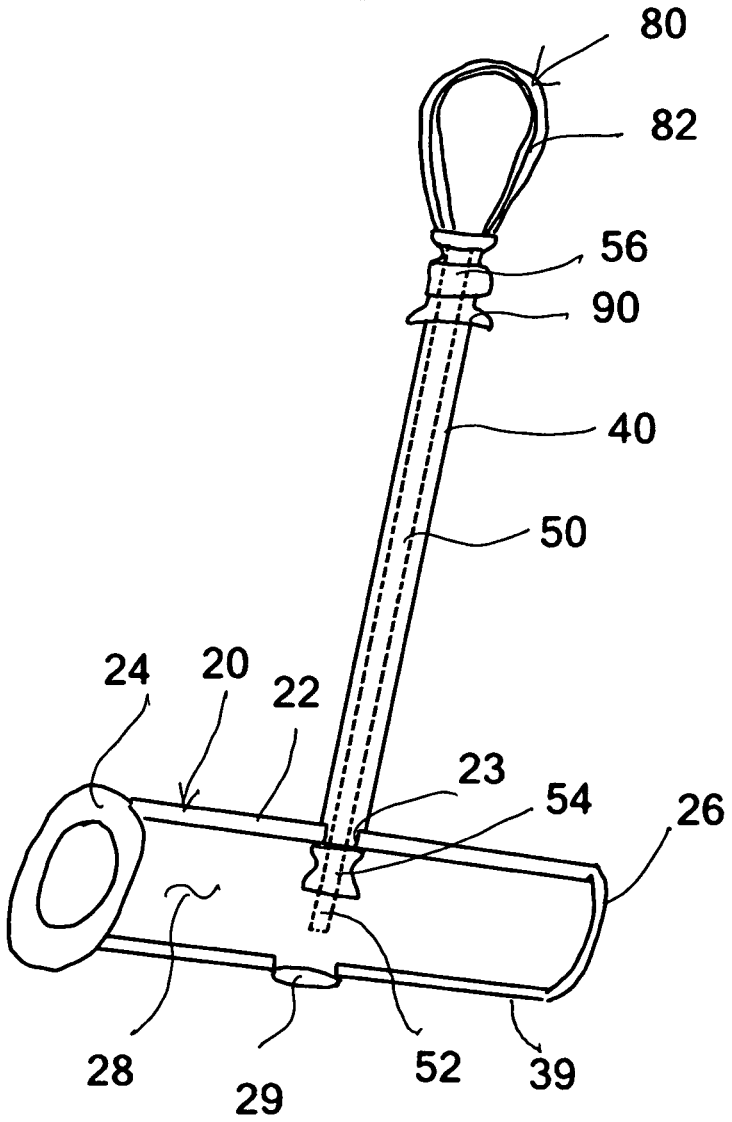
FIG. 8 is a diagrammatic view showing the center pull cable handle apparatus of the present invention and the location of the cable therein.

FIG. 8 shows the location of the cable or wire rope 50 inside the handle 20, inside the covered cable 40 and in the connector 80. In this embodiment, an extra opening 29 is provided to provide an alternative means to crimp the cable nut 54. The opening 29 is larger than the cable nut 54 and the cable nut can be crimped outside the opening 29 and then the cable end 52 and cable nut 54 can be pulled through the opening into final position as shown in FIG. 8. In the other embodiments of the invention which do not have opening 29, the cable nut 54 can be crimped onto the cable end 52 outside of opening 31 as shown in FIG. 5 and then pulled through such opening 31 to the final position shown in FIG. 5.

Figure 9A:
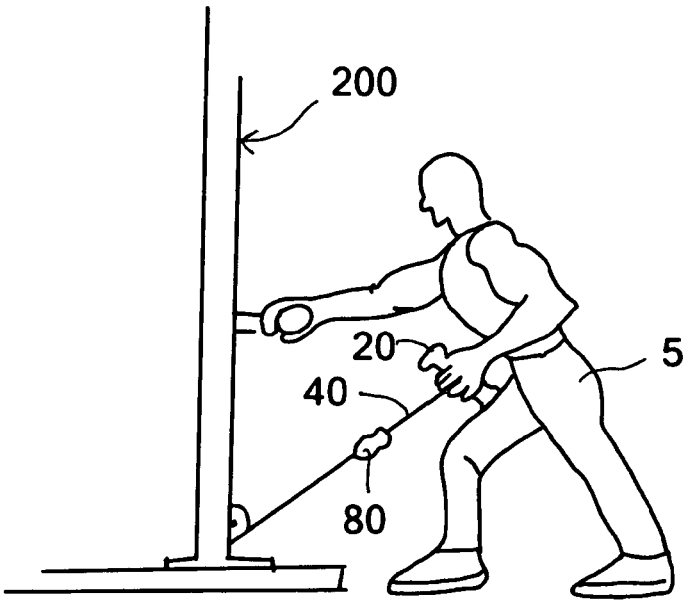
FIGS. 9*a* and 9*b* are perspective views showing the present invention attached to exercise machines.
Figure 9B:
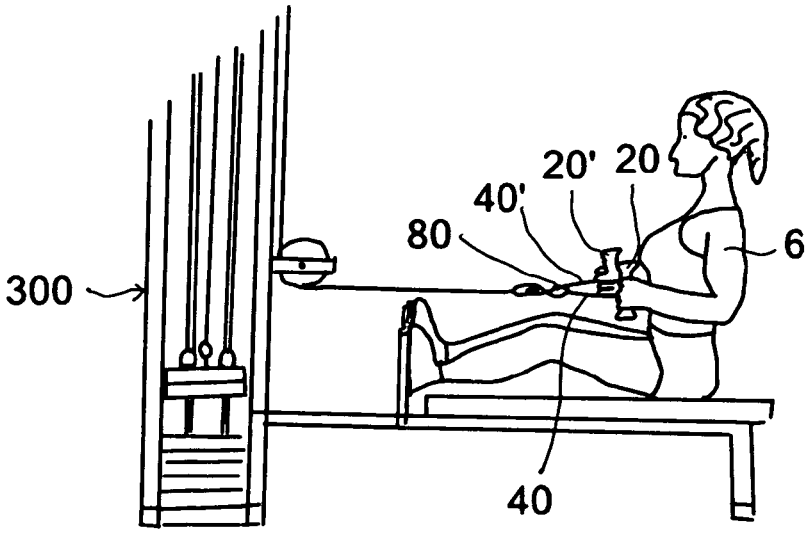

FIGS. 9*a* and 9*b* show the present invention as attached to exercise machines 200 and 300, respectively. In FIG. 9*a*, a user 5 is shown pulling a single handle 20 attached to covered cable 40 and connector 80 by which the device is attached to machine 200. In FIG. 9*b*, a user 6 is shown pulling on two handles 20, 20' attached by covered cables 40, 40', respectively, to a single connector 80 by which the device is attached to machine 300.

Figure 11:
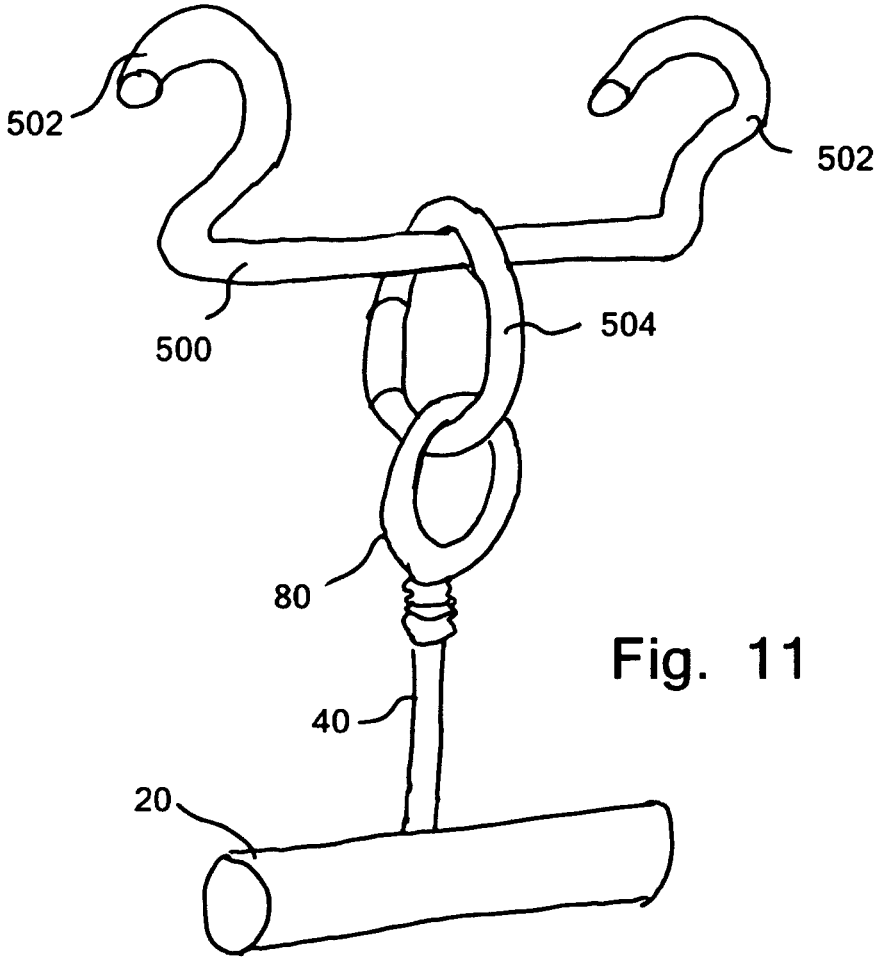
FIG. 11 is a perspective view of the center pull cable handle apparatus of the present invention as attached to a specialized hook bar for quick attachment to a horizontal bar member for pull up exercises.

FIG. 11 shows the center pull cable handle apparatus of the present invention as attached to a specialized hook bar for quick attachment to a horizontal bar member for pull up exercises. The hook member shown is better shown in FIG. 7 of Applicant's U.S. Pat. No. 7,008,355.

It is to be understood that while certain forms of the present invention have been illustrated and described herein, the present invention is not to be limited to the specific forms or arrangements of parts described and shown.

I claim:

1. A center pull cable handle apparatus comprising:

a) a length of hollow cylindrical steel tube having a cylindrical wall portion, a first open tube end, a second open tube end and an empty space between said first open tube end and said second open tube end, said cylindrical steel tube having a circular cross section of uniform diameter along an entire length of said tube between said first open tube end and said second open tube end, said cylindrical wall having a cable tube wall opening extending through the wall of the tube midway along the length of the tube between the first open tube end and the second open tube end;

b) an outer grip layer covering said cylindrical wall, said grip layer providing an increased and more comfortable grip than gripping said steel tube directly, said grip layer having a cable grip wall opening which is positioned adjacent to and aligned with said cable tube wall opening;

c) a length of aircraft cable having a first cable end extending through said cable tube wall opening and said cable grip layer opening and positioned in said empty space and having a second cable end extending transversely outward away from said grip layer;

d) a cable nut crimped onto said first cable end and positioned in said empty space, said cable nut being larger than said cable wall opening whereby securing said first cable end inside said steel tube;

e) a connector attached to said second cable end; and f) a length of flexible tubing surrounding said cable, said length of tubing extending from said grip layer to said connector, whereby when a user grasps the outer grip layer of the handle, the first cable end is located inside the grasp of the user and said cable and tubing pass between a ring finger and a middle finger of the user.

2. A center pull cable handle apparatus comprising:

a) a length of hollow cylindrical steel tube having a cylindrical wall portion, a first open tube end, a second open tube end and an empty space between said first open tube end and said second open tube end, said cylindrical wall having a cable tube wall opening extending through the wall of the tube midway along the length of the tube between the first open tube end and the second open tube end;

b) an outer grip layer on said cylindrical wall, said grip layer having a cable grip wall opening which is positioned adjacent to and aligned with said cable tube wall opening;

c) a length of aircraft cable having a first cable end extending through said cable tube wall opening and said cable grip layer opening and positioned in said empty space and having a second cable end extending transversely outward away from said grip layer;

d) a cable nut crimped onto said first cable end and positioned in said empty space, said cable nut being larger than said cable wall opening whereby securing said first cable end inside said steel tube;

e) a connector attached to said second cable end; and f) a length of flexible tubing surrounding said cable, said length of tubing extending from said grip layer to said connector, whereby when a user grasps the handle the first cable end is located inside the grasp of the user and said cable and tubing pass between two fingers of the user wherein said outer grip layer further comprises a rubberized handle grip member having a grip wall tightly surrounding said cylindrical wall and having a grip end covering said first open tube end, and a handle plug having a generally cylindrical insert portion sized to enter and be frictionally held inside said second tube opening and having a plug end and flange portion covering said second tube opening.

3. A center cable apparatus according to claim 1 wherein said outer grip layer further comprises a layer of foam which surrounds said cylindrical wall.

4. A center cable apparatus according to claim 1 wherein said outer grip layer further comprises a layer of textured paint.

5. A center pull cable handle apparatus according to claim 1 wherein said length of flexible tubing is longer than a distance from said grip layer to said connector whereby said length of tubing is compressed between said grip layer and said connector causing a gapless tight fit at an interface of the latex tubing and the grip layer.

6. A center pull cable handle apparatus according to claim 1 wherein said flexible tubing is formed of latex.

7. A center pull cable handle apparatus according to claim 1 wherein said flexible tubing is formed of vinyl.

8. A center pull cable handle apparatus according to claim 1 wherein said connector further comprises a crimp style cable nut having a first nut opening and second nut opening and a cable thimble with said second cable end extending though said first nut opening, thence around said thimble and thence through said second nut opening and being crimped in place.

9. A center pull cable handle apparatus comprising:

a) a length of hollow cylindrical steel tube having a cylindrical wall portion, a first open tube end, a second open tube end and an empty space between said first open tube end and said second open tube end, said cylindrical wall having a cable tube wall opening extending through the wall of the tube midway along the length of the tube between the first open tube end and the second open tube end;

b) an outer grip layer on said cylindrical wall, said grip layer having a cable grip wall opening which is positioned adjacent to and aligned with said cable tube wall opening;

c) a length of aircraft cable having a first cable end extending through said cable tube wall opening and said cable grip layer opening and positioned in said empty space and having a second cable end extending transversely outward away from said grip layer;

d) a cable nut crimped onto said first cable end and positioned in said empty space, said cable nut being larger than said cable wall opening whereby securing said first cable end inside said steel tube;

e) a connector attached to said second cable end; and f) a length of flexible tubing surrounding said cable, said length of tubing extending from said grip layer to said connector, whereby when a user grasps the handle the first cable end is located inside the grasp of the user and said cable and tubing pass between two fingers of the user, wherein said connector further comprises a crimp style cable nut having a first nut opening and second nut opening and a cable thimble with said second cable end extending through said first nut opening, thence around said thimble and thence through said second nut opening and being crimped in place and wherein said second cable end extends through said second nut opening and forms the second end of a second center pull handle apparatus whereby two center pull handle devices are connected to a single connector at a juxtaposed location.

10. A center pull cable handle apparatus according to claim 1 wherein said connector further comprises a ball crimp member crimped onto said second cable end with said ball member extending through a slot in a yoke, said yoke pivotally mounted to a square tubular block adapted for connection to an exercise machine.

11. A center pull cable handle apparatus according to claim 1 wherein said connector further comprises a steel tubeconnector having an opening for said second cable end secured with a crimped cable nut, said steel tube connector having a second opening, spaced from said first opening, for a second cable end of a second center pull handle apparatus whereby two center pull handle devices are connected to a single connector at a spaced apart location, said steel tube connector having a central hook for attachment to an exercise machine.

* * * * *